United States Patent [19]

Rakowsky et al.

[11] 4,240,257

[45] Dec. 23, 1980

[54] HEAT PIPE TURBO GENERATOR

[75] Inventors: Edward L. Rakowsky, Kinnelon; Lawrence S. Galowin, Upper Saddle River, both of N.J.

[73] Assignee: The Singer Company, Little Falls, N.J.

[21] Appl. No.: 334,901

[22] Filed: Feb. 22, 1973

[51] Int. Cl.[3] ..... F01K 11/02

[52] U.S. Cl. ..... 60/531; 60/670; 60/669; 165/105

[58] Field of Search ..... 60/531, 669, 670, 651, 60/671; 165/105

[56] References Cited

U.S. PATENT DOCUMENTS 3,670,495 6/1972 Leffert ..... 60/531

*Primary Examiner*—Allen M. Ostrager

*Attorney, Agent, or Firm*—Thomas W. Kennedy; John C. Altmiller

[57] ABSTRACT

The adaptation of a heat pipe as a turbo-generator or other power output device for a reliable, quiet, light-weight high-endurance power source is shown. The device requires input thermal energy from a burner radioisotope (or solar heat) and also forced or natural heat rejection from condenser surfaces. Thermal energy conversion to a suitable power output is accomplished by encapsulating a turbine wheel within a heat pipe shell, located in an appropriately geometrical contoured section. Flow work extracted from the kinetic energy of the vapor flow provides rotary shaft power output. The shaft power can drive an electrical generator, pump, compressor, or similar device, also mounted within the heat pipe shell structure. A completely self-contained enclosed unit is provided which requires only external power connection at attachment terminals.

16 Claims, 7 Drawing Figures

HEAT PIPE TURBO GENERATOR

BACKGROUND OF THE INVENTION

This invention relates to heat pipes in general, and more particularly to the adaptation of a heat pipe as a turbo-generator or other power output device. In general terms, a heat pipe comprises an enclosed container having on its inner surfaces a capillary wick saturated with a material which will vaporize at the operating temperatures of the heat pipe. For purposes of discussion and for use in the particular application to be disclosed herein, a pipe which comprises an elongated cylinder will be considered. It should be noted, however, that heat pipes may be constructed in other shapes and forms. At one end of the pipe heat is applied to cause the liquid in the wick area to be vaporized. This vapor containing the latent heat of vaporization, then flows to the other end of the pipe where means are provided to condense this vapor. The condensed vapor then flows back to the other end of the heat pipe via the surface tension pumping in the capillary wick. Since the heat pipe can operate without the aid of condensate (feedwater) pumps, it differs from conventional boiling-condensing RANKINE cycle power generation devices.

In general, prior art heat devices have been used to transfer heat in turbines in the like to improve the efficiencies thereof, and to provide cooling. For example, see U.S. Pat. Nos. 3,287,906 and 3,429,122. None of these prior art devices make use of the vapor flow within the heat pipe to obtain any useful output.

SUMMARY OF THE INVENTION

The present invention makes use of the heat pipe phenomenon and the high vapor flow velocities which result therein to provide a reliable, quiet, light-weight, high-endurance power supply, by placing within a properly contoured section of the heat pipe a turbine wheel. With the addition of conventional heating means and means to obtain heat rejection from the condenser surfaces, and an appropriate output device such as an electrical generator, pump compressor, etc., a self contained power unit is provided. In another embodiment the heat pipe is caused to rotate while the turbine rotor becomes the stationary element. This improvement offers advantages overcoming working limitations and improving fluid flow.

DETAILED DESCRIPTION OF THE PREFERRED EMBODIMENT

Figure 1:
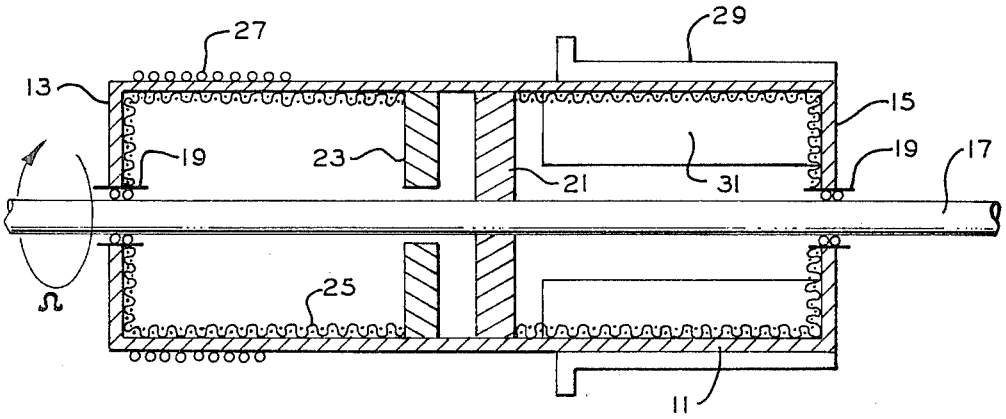
FIG. 1 is a cross section view of a first embodiment of the heat pipe turbine of the present invention.
Figure 2A:
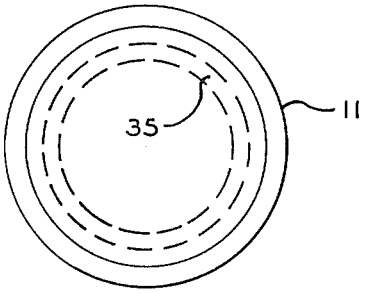
FIG. 2 is an end view illustrating various wick arrangements for use in the heat pipe of FIG. 1.
Figure 2B:
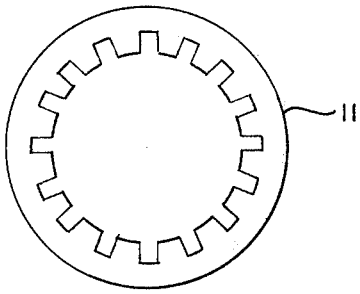
Figure 2C:
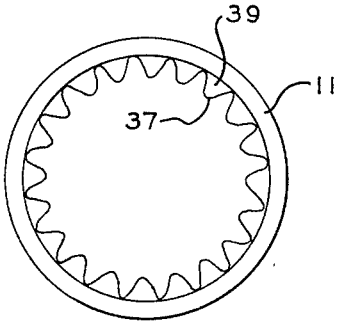
Figure 2D:
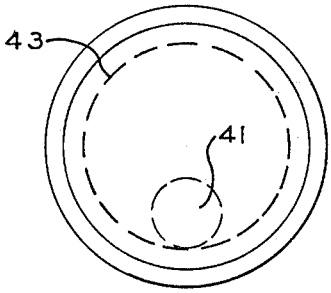

FIG. 1 shows a cross section view of a first embodiment of the invention. The basic heat pipe comprises a hollow cylindrical structure 11 closed by end pieces 13 and 15 each of which contains a hole through which a turbine shaft 17 may extend. The turbine shaft 17 is mounted in conventional bearing means 19 in the holes in end pieces 13 and 15 for rotation therein. Affixed to the turbine shaft is a turbine rotor 21. Affixed to the inside of the cylinder 11 is a turbine stator 23. All of the inner surfaces of the cylinder 11 and the ends 13 and 15 are covered with a wick material 25 to be described below. At the end of the cylinder 11 closest to end 13 heating coils 27 are provided in which heated fluid may be provided in conventional fashion. At the other end of the cylinder 11 cooling coils 29 through which cooling water may be pumped may be provided. In addition, affixed to the inner surface of cylinder 11 at this end are cooling fins 31. These will be a plurality of fins extending radially from the circumference of the cylinder 11 to aid in cooling the vapor. The wick 25 will be saturated with a material that liquifies and vaporizes at the operating temperatures within the heat pipe. Examples of materials which may be used are given below. It should be noted that some of these materials are normally solid at room temperature. However, at the operating temperatures within the heat pipe they will be either liquid or vapor.

The following materials list indicates the extent of reported studies; note the inclusion of usually solids that liquefy and vaporize at elevated temperatures.

Ammonia
Methanol
Ethanol
Acetone
Water
Dowtherm
Ethylene Glycol
Mercury
Freon
Cesium
Napthalene
Potassium
Sodium
Indium
Lithium
Bismuth
Lead
Inorganic Salts Theoretically, the operating temperature range is limited between the melting point and critical point temperatures. In practice, however, the heat transport rates are found to be low near the melting point because of low vapor pressures and not practical near the critical point because of excessively high vapor pressures. In experiments with a two-fluid heat pipe by K. T. Feldman, Jr. and Al Whitley, Energy Conversion Systems, Alburquerque, New Mexico improvements in heat pipe performance with two fluids was reported by the addition of 24% (liquid volume) of methanol to water. The higher vapor pressure methanol substantially is found therein to increase the pressure and density of the water vapor.

In order to impose a tightly requlated operating temperature on the heat pipe, the addition of an inert gas (during the fill) regulates the vapor pressure-temperature relationship. Variation in the power input to a gas-controlled heat pipe varies access to the heat sink area in proportion to the power change. The tests over a 38:1 power input range with temperature control of a few tenths of one percent were indicated in *The Heat Pipe—A Progress Report* by G. Y. Eastman, RCA Corporation, Lancaster, Pennsylvania. Since this is a demand type thermal switch, the design provides temperature regulation to the conversion system and serves to dissipate power in excess of demands of the energy converter. Operating times in excess of 20,000 hours have been reported.

In operation, heat will be supplied through heating coils 27 to evaporate the material in the wick 25. The vapor will then tend to flow from the end 13 to the end 15 of the heat pipe. The vapor will be directed through a turbine stator which will develop forces in the well known manner by turning of the incoming velocity vector and/or expanding the vapor into and through the blades of the turbine rotor 21. The turbine may be either an axial or radial flow turbine with partial or full admission dependent upon the particular design. Such turbine design is well known within the art and will not be discussed herein. The vapor velocity is thus converted to cause the turbine shaft to rotate. The vapor is then, after being used, expelled into the end 15 of the heat pipe. Here the cooling fins 31 and the cooling water through the cooling pipes 29 will condense the vapor which will then be collected by the wick 25. The capillary pumping action of the wick will then cause the liquefied material to be pumped back to the end 13 of the heat pipe so that the process may continue.

FIG. 2 illustrates various wick configurations. In FIG. 2A a wick of several layers of fine mesh screen 35 is provided fitted closely to the inner wall of the cylinder 11. In FIG. 2B there is shown a configuration comprising open channels on the inner wall of the cylinder 11. The channels may also be covered with a screen mesh to improve the collection and condensation of the vapor. FIG. 2C shows a corrugated screen configuration. The screen 37 is formed in a corrugated manner so that basically triangular shaped liquid flow channels 39 are provided within the cylinder 11. FIG. 2D shows a wick in which there is provided a main artery 41 to return the liquid along with screen mesh 43 to collect and provide the liquid to the artery.

In addition to the various configurations, it is also possible to use various types of wick material. Three broad types of wick material which have proven useful are as follows:

A. A mesh comprised of woven wires as a screen,

B. Powdered or particulate materials either sintered into a homogeneous porous solid or held by a retainer, and C. Fiber strands randomly assembled into a mat form and sintered into an essentially homogeneous porous solid.

An example of a type of screen mesh which may be used is 15% dense Rigimesh manufactured by the Pall Corporation.

Although the heat pipe of FIG. 1 is shown as being horizontal, improved pumping action may be obtained by making use of the force of gravity. Thus, it is preferable to mount the heat pipe vertically with the end 15 up so that gravity will aid in returning the liquid to the end 13. An output device such as an electrical generator, pump compressor, etc., can be attached to the turbine shaft 17 and made an integral part of the apparatus to provide a self contained power unit.

Figure 3:
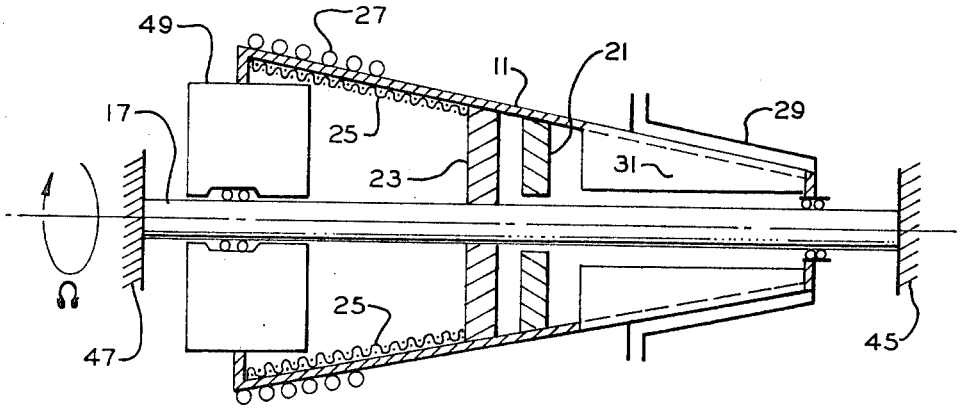
FIG. 3 is a cross section view of a second embodiment of the heat pipe turbine in which the shaft is held fixed.

A second embodiment of the invention is shown in FIG. 3. In this embodiment the shaft is held fixed and the heat pipe allowed to rotate. The major advantage of this embodiment is that the capillary wick pumping limitations of returning the condensate against the adverse internal pressure within the turbine is eliminated, and the pumping is governed only by the angular velocity and contour design of the heat pipe. In this embodiment, elements which are common to FIG. 1 will be given identical reference numerals. The shaft 17 is now held fixed between the surfaces 45 and 47. The heat pipe enclosure is now in the form of a part of a cone rather than a cylinder. The rotor element of an electric generator, for example, shown schematically as 49 can be made integral with the cone 11 to rotate therewith. Suitable stator elements, not shown, would be affixed to the support 47. Operation would be as before, with the heating coils vaporizing the liquid which would then be passed through the turbine stator 23 and rotor 21 to the cooling coils 31 where it would be condensed by the coils and the cooling water in cooling pipes 29 to return through the wicking 25. However, with the shaft 17 fixed, the whole structure, other than shaft 17, and rotor 21 will be caused to rotate by the forces within the turbine. The forces developed will then enhance the pumping of the liquid back from the condensing section to the heating area and thus overcome any limitations caused by the pressure behind the turbine stator impeding the flow.

Figure 4:
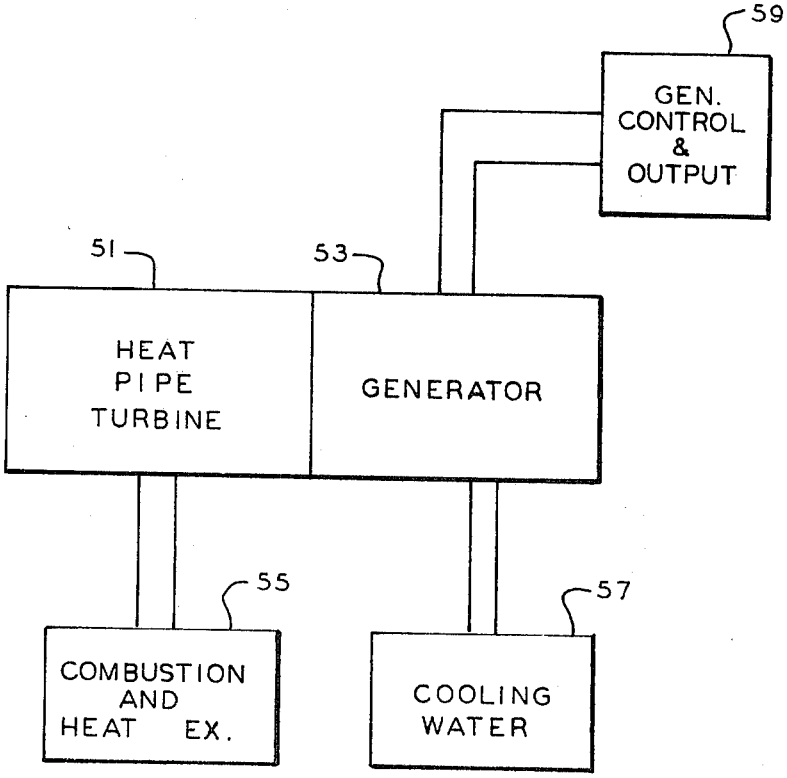
FIG. 4 is a block diagram of a typical application of the heat pipe turbine.

FIG. 4 illustrates in block diagram form, a typical installation of the apparatus. The heat pipe turbine 51 and a generator 53 will be assembled in a single package. This unit may then be installed as a compact self contained unit with only the addition of a combustion and heat exchange unit 55, for example, an oil fired boiler, and a cooling water supply 57 which could, for example, comprise a pump and heat exchanger, and controls and output terminals for the generator 53 indicated collectively by block 59. The types of devices which will perform the functions of block 55, 57, and 59 are well known in the art and may easily be provided.

Thus, a simple, light-weight, compact, high endurance power source which requires only a minimum of external equipment has been shown. Although specific embodiments have been shown and described, it will be obvious to those skilled in the art that various modifications may be made without departing from the spirit of the invention which is intended to be limited solely by the appended claims.

What is claimed is:

1. A heat pipe turbine comprising:

(a) closed container of generally cylindrical shape having its inside coated with a wick material, said wick material being saturated with a substance which is a liquid at the operating temperature of the turbine;

(b) means at one end of said container to supply heat thereto to vaporize said liquid;

(c) means at the other end of said container to condense the vaporized liquid;

(d) a shaft rotatable within said container with its axis coincident with that of said container;

(e) a turbine rotor affixed to said shaft essentially at the longitudinal center of said container;

(f) a turbine stator affixed to said container on the side of said rotor nearest said first end and positioned to cooperate with said rotor to provide a turbine action whereby said vaporized liquid will pass through said turbine stator and rotor imparting relative rotation there between.

2. The invention according to claim 1 wherein said container is secured to prevent rotation thereof whereby the relative rotation will cause said shaft to rotate.

3. The invention according to claim 2 wherein said shaft is coupled to an output device.

4. The invention according to claim 3 wherein said device is an electric generator.

5. The invention according to claim 1 wherein said shaft is fixed to prevent rotation whereby the relative rotation will cause said container to rotate.

6. The invention according to claim 5 wherein there is attached to said container the rotor element of an output device.

7. The invention according to claim 6 wherein said rotor element is the rotor of an electrical generator.

8. The invention according to claim 1 wherein said wick comprises several layers of fine mesh screen closely fitted to the inner surface of said container.

9. The invention according to claim 1 wherein said wick comprises open channels in the inner wall of said container.

10. The invention according to claim 9 wherein said channels are covered with screens.

11. The invention according to claim 1 wherein said wick comprises a screen corrugated to form triangular shaped liquid flow channels.

12. The invention according to claim 1 wherein said wick comprises a tube for main liquid flow and a screen wick supplying liquid to said tube.

13. The invention according to claim 1 wherein said wick material comprises particulate materials held against the inner wall of said container.

14. The invention according to claim 13 wherein said particulate materials are sintered into a homogeneous porous solid.

15. The invention according to claim 13 wherein said particulate materials are held by a retainer.

16. The invention according to claim 1 wherein said wick material comprises fiber strands randomly assembled into a mat and sintered into an essentially homogeneous porous solid.

* * * * *